US010378804B2

(12) United States Patent
McMasters et al.

(10) Patent No.: US 10,378,804 B2
(45) Date of Patent: Aug. 13, 2019

(54) SYSTEM AND METHOD FOR INJECTING OIL INTO AN AIR CONDITIONING CIRCUIT

(71) Applicants: Mark W. McMasters, Owatonna, MN (US); Dylan M. Lundberg, Lonsdale, MN (US); Robert Bosch GmbH, Stuttgart (DE)

(72) Inventors: Mark W. McMasters, Owatonna, MN (US); Dylan M. Lundberg, Lonsdale, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 318 days.

(21) Appl. No.: 15/305,777

(22) PCT Filed: Apr. 24, 2015

(86) PCT No.: PCT/US2015/027494

§ 371 (c)(1),
(2) Date: Oct. 21, 2016

(87) PCT Pub. No.: WO2015/164725

PCT Pub. Date: Oct. 29, 2015

(65) Prior Publication Data

US 2017/0045277 A1 Feb. 16, 2017

Related U.S. Application Data

(60) Provisional application No. 61/983,622, filed on Apr. 24, 2014.

(51) Int. Cl.
*F25B 45/00* (2006.01)
*F01M 11/04* (2006.01)

(52) U.S. Cl.
CPC ..... *F25B 45/00* (2013.01); *F01M 11/0458* (2013.01); *F25B 2345/001* (2013.01); *F25B 2345/005* (2013.01); *F25B 2345/007* (2013.01)

(58) Field of Classification Search
CPC . F25B 2345/007; F25B 45/00; F01M 11/0458
See application file for complete search history.

(56) References Cited

U.S. PATENT DOCUMENTS 4,755,957 A 7/1988 White et al.
5,787,372 A * 7/1998 Edwards ..... F01M 11/0458 123/198 DA (Continued)

FOREIGN PATENT DOCUMENTS

CN 102954638 A 3/2013

OTHER PUBLICATIONS

International Search Report corresponding to PCT Application No. PCT/US2015/027494, dated Aug. 11, 2015 (3 pages).

(Continued)

*Primary Examiner* — David J Teitelbaum
(74) *Attorney, Agent, or Firm* — Maginot Moore & Beck LLP

(57) ABSTRACT

An air conditioning service system includes an oil receptacle, a coupling port in fluid communication with the oil receptacle through an oil injection line, a solenoid valve configured to selectively allow the oil to flow from the oil receptacle into the oil injection line, a memory including program instructions stored therein, and a controller operably connected to the solenoid valve and the memory. The controller is configured to execute the program instructions to obtain at least one viscosity signal associated with a viscosity of the oil, obtain a volume signal indicative of an amount of oil to be charged, determine a time period based upon the obtained at least one viscosity signal and the (Continued)

obtained volume signal, control the solenoid valve to an open condition, and control the solenoid valve to a closed condition after the determined time period has passed since opening of the solenoid valve.

18 Claims, 8 Drawing Sheets

(56) References Cited

U.S. PATENT DOCUMENTS

| | | | |
|---|---|---|---|
| 7,854,130 | B2 | 12/2010 | Brown et al. |
| 8,590,321 | B2 | 11/2013 | McMasters |
| 8,590,335 | B2 | 11/2013 | Brown et al. |
| 2006/0130510 | A1 | 6/2006 | Murray et al. |
| 2009/0188263 | A1 | 7/2009 | Murray et al. |
| 2011/0146304 | A1 | 6/2011 | Brown et al. |
| 2012/0079839 | A1 | 4/2012 | McMasters |

OTHER PUBLICATIONS

English Translation of Chinese First Office Action corresponding to Chinese Patent Application No. 201580030248.5 (8 pages).

* cited by examiner

SYSTEM AND METHOD FOR INJECTING OIL INTO AN AIR CONDITIONING CIRCUIT

This application is a 35 U.S.C. § 371 National Stage Application of PCT/US2015/027494, filed on Apr. 24, 2015, which claims the benefit of priority to U.S. provisional application Ser. No. 61/983,622, filed Apr. 24, 2014, entitled "System and Method for Injecting Oil into an Air Conditioning System," the disclosures of which are incorporated herein by reference in their entireties.

TECHNICAL FIELD

This disclosure relates generally to refrigeration systems, and more particularly to refrigerant recovery systems for refrigeration systems.

BACKGROUND

Air conditioning systems include a mechanical compressor that compresses refrigerant flowing through the air conditioning system. The compressor requires oil to function properly and efficiently. During normal operation of the air conditioning system, a portion of the compressor oil is entrained in the refrigerant and circulated through the air conditioning system. When the air conditioning system is serviced, the refrigerant, along with the oil entrained therein, is typically removed from the air conditioning system. Additionally, the air conditioning system may require replacement of parts within the circuit, which can also remove compressor oil within the replaced parts. As such, new compressor oil must be injected into the system to replace oil removed from the system during maintenance and service operations. For this reason, most air conditioning service ("ACS") machines include a circuit for injecting oil into the air conditioning circuit prior to recharging refrigerant into the air conditioning system.

Measuring the oil injected into the air conditioning circuit is important to ensure the proper quantity of compressor oil is in the air conditioning circuit. Excess or insufficient oil in the compressor reduces the overall operational efficiency of the air conditioning circuit. One commonly used method of measuring oil injected into the air conditioning circuit is visual identification. Some conventional ACS machines include a bottle of oil having graduated markings that indicate the amount of oil in the bottle. To measure the quantity of oil injected into the circuit, the user monitors the oil level in the bottle with reference to the graduated markings as the ACS machine injects the oil, and terminates the injection operation when the desired quantity of oil appears to have been injected. This method has the lowest cost, but relies entirely on the user to monitor the bottle and inject the correct amount. As a result, the visual identification method suffers from issues, including operator error and inaccuracy of the markings or in reading the markings that can cause deviation from the desired quantity of oil injected into the air conditioning circuit.

Some conventional ACS machines include a load cell associated with the oil bottle to measure the weight of the oil bottle. The ACS system is configured with a controller that subtracts the weight of the bottle during the injection process from the initial weight of the bottle to determine the amount of oil injected. Once the controller determines that the desired quantity of oil has been injected into the circuit, the controller operates the oil injection valve to close. However, load cells are expensive and delicate, and, as a result, ACS machines having a load cell for the oil bottle are costly to manufacture and maintain, and may malfunction if handled incorrectly.

Other typical ACS machines estimate the quantity of oil injected into the air conditioning system based on the time the oil injection solenoid valve is open. The oil flow rate is assumed, and a length of time that the oil injection solenoid valve needs to be open in order to inject the desired quantity of oil is estimated from the assumed oil flow rate. For example, in some ACS machines, the oil flow rate is assumed to be 2 ml per second. A user inputs the amount of oil for the system to inject, for example 10 ml. The ACS controller then calculates the time the system should be open, which, in this example, is 5 seconds.

One issue with such an oil injection method is that the oil flow rate is not a constant. The flow rate varies depending on the oil viscosity and the temperature of the oil, which is typically approximately the ambient temperature of the ACS machine. Some ACS machines that include time-based oil injection also include a way for the user to input a correction factor to correct the injected quantity or the time the valve is open based on variations in the flow rate due to the current conditions. One problem with this is that the user may not have accurate information to determine the proper correction factor. Another issue is that the user may be required to perform baseline tests or calculations in order to determine the correction factor, and errors in these tests or calculations can result in an incorrect correction factor being input to the machine. As a result, the time injection method fails to provide adequate accuracy due to the required user intervention and system variables.

For all of the above reasons, it would be desirable to provide an ACS machine that improves the precision of the quantity of oil injected into an air conditioning system at a low cost. Additionally, it would be desirable to provide an ACS machine that accurately injects a desired quantity of oil into the air conditioning system with minimal user intervention.

SUMMARY

In one embodiment, an air conditioning service system comprises an oil receptacle configured to store oil, a coupling port in fluid communication with the oil receptacle through an oil injection line, a first solenoid valve configured to selectively allow the oil to flow from the oil receptacle into the oil injection line, a memory including program instructions stored therein, and a controller operably connected to the first solenoid valve and the memory. The controller is configured to execute the program instructions to obtain at least one viscosity signal associated with a viscosity of the oil, obtain a volume signal indicative of an amount of oil to be charged, determine a first time period based upon the obtained at least one viscosity signal and the obtained volume signal, control the first solenoid valve to an open condition, and control the first solenoid valve to a closed condition after the determined first time period has passed since opening of the first solenoid valve. Determining the time period over which the oil is injected from the oil receptacle based upon the viscosity signal enables quick and accurate injection of the oil without the need for expensive equipment, such as a load cell.

In an embodiment of the air conditioning service system, the at least one viscosity signal comprises a first temperature signal indicative of a temperature of one of the oil receptacle and ambient surroundings of the air conditioning service system. In a further embodiment, the air conditioning service system includes a temperature sensor configured to generate the first temperature signal.

In another embodiment, the at least one viscosity signal comprises a first oil type signal associated with a type of the oil.

In some embodiments, the air conditioning service system further comprises a vacuum pump configured to generate a vacuum in the oil injection line, and the controller is operably connected to the vacuum pump and further configured to execute the program instructions to control the vacuum pump to generate a vacuum in the oil injection line prior to controlling the first solenoid valve to the open condition.

In one embodiment, the air conditioning service system further comprises a second solenoid valve configured to selectively isolate the oil receptacle from the oil injection line, a chamber having an inlet in fluid communication with the first solenoid valve and an outlet in fluid communication with the second solenoid valve, and a pressure sensor configured to generate pressure signals associated with pressures of the chamber. The controller is further operably connected to the second solenoid valve and the pressure sensor and configured to execute the program instructions to generate the at least one viscosity signal during a viscosity determining procedure using the generated pressure signals.

In a further embodiment, the controller is configured to execute the program instructions to perform the viscosity determining procedure. The viscosity determining procedure comprises controlling the first solenoid valve to a closed position, generating a vacuum in the chamber, controlling the first solenoid valve to an open position thereby placing the chamber in fluid communication with the oil receptacle, obtaining a first of the generated pressure signals after controlling the first solenoid valve to the open position, and generating the at least one viscosity signal based upon the obtained first of the generated pressure signals and a second time period between controlling the first solenoid valve to the open position and obtaining the first of the generated pressure signals.

In yet another embodiment, the viscosity determining procedure further comprises controlling the second solenoid valve to an open position before generating the vacuum in the chamber, generating the vacuum in the chamber through the second solenoid valve, and controlling the second solenoid valve to a closed position after the vacuum has been generated.

In some embodiments, the viscosity determining procedure further comprises obtaining a second of the generated pressure signals after controlling the second solenoid valve to a closed position and prior to controlling the first solenoid valve to the open position, and generating the at least one viscosity signal based upon the obtained second of the generated pressure signals.

Some embodiments of the air conditioning system include a vacuum pump configured to generate the vacuum in the chamber. The controller is operably connected to the vacuum pump and further configured to execute the program instructions to control the vacuum pump to generate the vacuum in the chamber.

In another embodiment, a method of injecting oil into an oil injection line of an air conditioning service system, comprises obtaining with a controller at least one viscosity signal associated with a viscosity of the oil, obtaining with the controller a volume signal indicative of an amount of oil to be charged, and determining a first time period based upon the obtained at least one viscosity signal and the obtained volume signal by executing with the controller program instructions stored in a memory. The method further includes placing an oil injection line in fluid communication with an oil receptacle by controlling the first solenoid valve to an open condition with the controller, flowing oil from the oil receptacle into the oil injection line through the open first solenoid valve, and controlling the first solenoid valve to a closed condition with the controller after the determined first time period has passed since opening of the first solenoid valve.

In another embodiment of the method, the obtaining of the at least one viscosity signal comprises obtaining a first temperature signal indicative of a temperature of one of the oil receptacle and ambient surroundings of the air conditioning service system. In some embodiments, the obtaining of the first temperature signal comprises obtaining the temperature signal with a temperature sensor.

In a further embodiment, the obtaining of the at least one viscosity signal comprises obtaining a first oil type signal associated with a type of the oil.

In yet another embodiment, the method further comprises generating, with a vacuum pump operably connected to the controller, a vacuum in the oil injection line prior to controlling the first solenoid valve to the open condition.

In some embodiments, the method further comprises obtaining with a pressure sensor pressure signals associated with pressures of a chamber having an inlet in fluid communication with the first solenoid valve and an outlet in fluid communication with a second solenoid valve that is configured to selectively isolate the oil receptacle from the oil injection line, and generating the at least one viscosity signal during a viscosity determining procedure using the generated pressure signals.

In one embodiment of the method, the viscosity determining procedure comprises controlling the first solenoid valve to a closed position, generating a vacuum in the chamber, and controlling the first solenoid valve to an open position thereby placing the chamber in fluid communication with the oil receptacle. The viscosity determining procedure further includes obtaining a first of the obtained pressure signals after controlling the first solenoid valve to the open position and generating the at least one viscosity signal based upon the obtained first of the generated pressure signals and a second time period between controlling the first solenoid valve to the open position and obtaining the first of the generated pressure signals.

In another embodiment, the viscosity determining procedure further comprises controlling the second solenoid valve to an open position before generating the vacuum in the chamber, generating the vacuum in the chamber through the second solenoid valve, and controlling the second solenoid valve to a closed position after the vacuum has been generated.

In a further embodiment, the viscosity determining procedure further comprises obtaining a second of the generated pressure signals after controlling the second solenoid valve to a closed position and prior to controlling the first solenoid valve to the open position, and generating the at least one viscosity signal based upon the obtained second of the generated pressure signals.

In another embodiment of the method, the generating of the vacuum in the chamber comprises operating a vacuum pump operably connected to the controller to generate the vacuum in the chamber.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
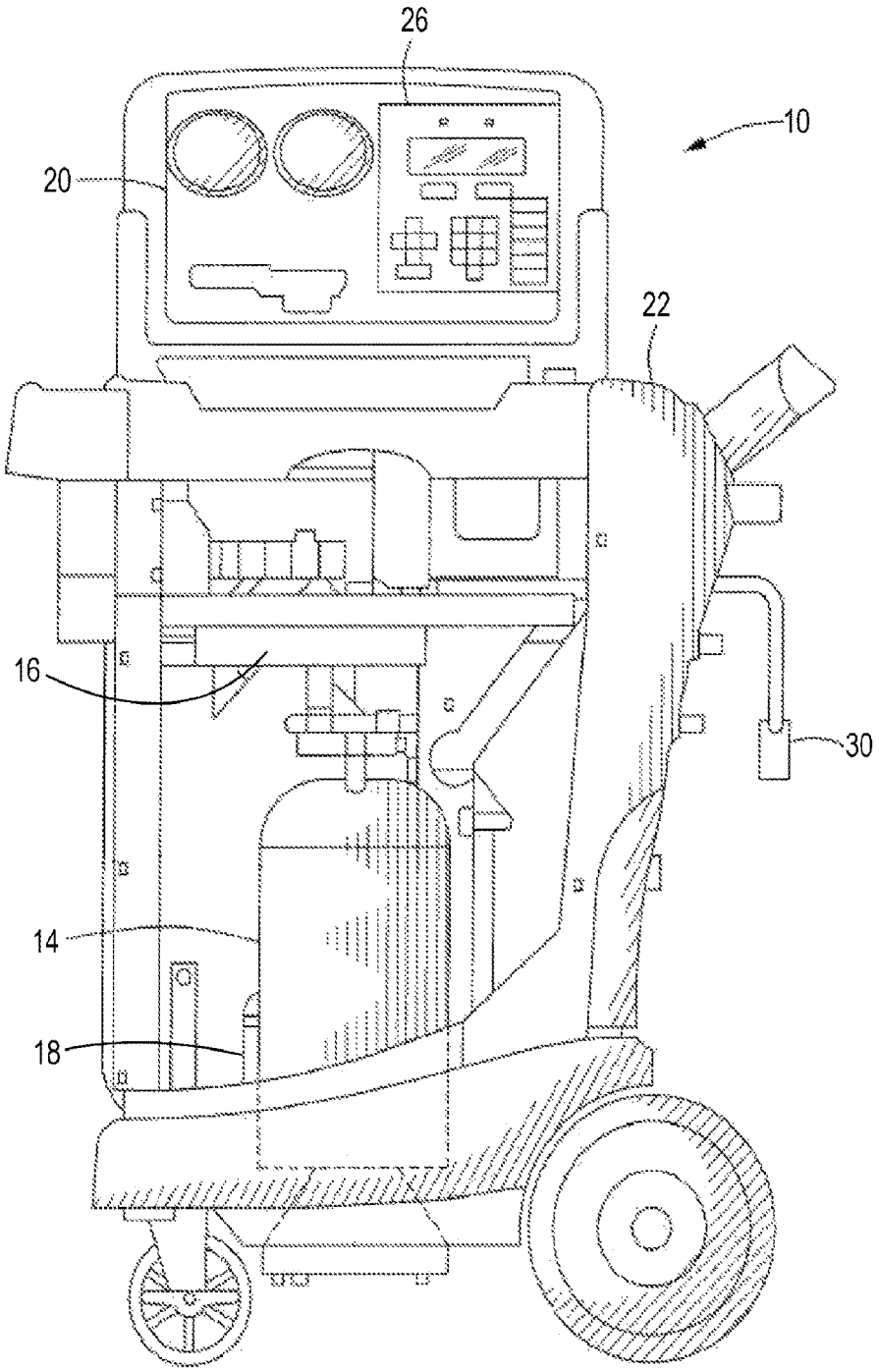
FIG. 1 PRIOR ART
FIG. 1 is a partial cutaway front view of a refrigerant service system.

FIG. 1 is an illustration of an air conditioning service ("ACS") system 10 according to the disclosure. The ACS system 10 includes a refrigerant container or internal storage vessel ("ISV") 14, a manifold block 16, a compressor 18, a control module 20, and a housing 22. The exterior of the control module 20 includes an input/output unit or user input interface 26 for input of control commands by a user and output of information to the user. Hose connections 30, 32 (only one is shown in FIG. 1), which are also referred to herein as coupling ports, protrude from the housing 22 to connect to service hoses that connect to an air conditioning ("A/C") system (also referred to herein as an "air conditioning circuit") and facilitate transfer of refrigerant between the ACS system 10 and the A/C system.

The ISV 14 is configured to store refrigerant for the ACS system 10. No limitations are placed on the kind of refrigerant that may be used in the ACS system 10. As such, the ISV 14 is configured to accommodate any refrigerant that is desired to be charged to the A/C system. In some embodiments, the ISV 14 is particularly configured to accommodate one or more refrigerants that are commonly used in the A/C systems of vehicles (e.g., cars, trucks, boats, planes, etc.), for example R-134a, $CO_2$, or R1234yf. In some embodiments, the ACS unit has multiple ISV tanks configured to store different refrigerants.

The manifold block 16 is fluidly connected to the ISV 14, the compressor 18, and the hose connections 30, 32 through a series of valves, hoses, and tubes. The manifold block 16 includes valves and components configured to filter and purify refrigerant recovered from a vehicle during a refrigerant recovery operation prior to the refrigerant being stored in the ISV 14, and to recharge the refrigerant back into the air conditioning circuit from the ISV 14.

Figure 2:
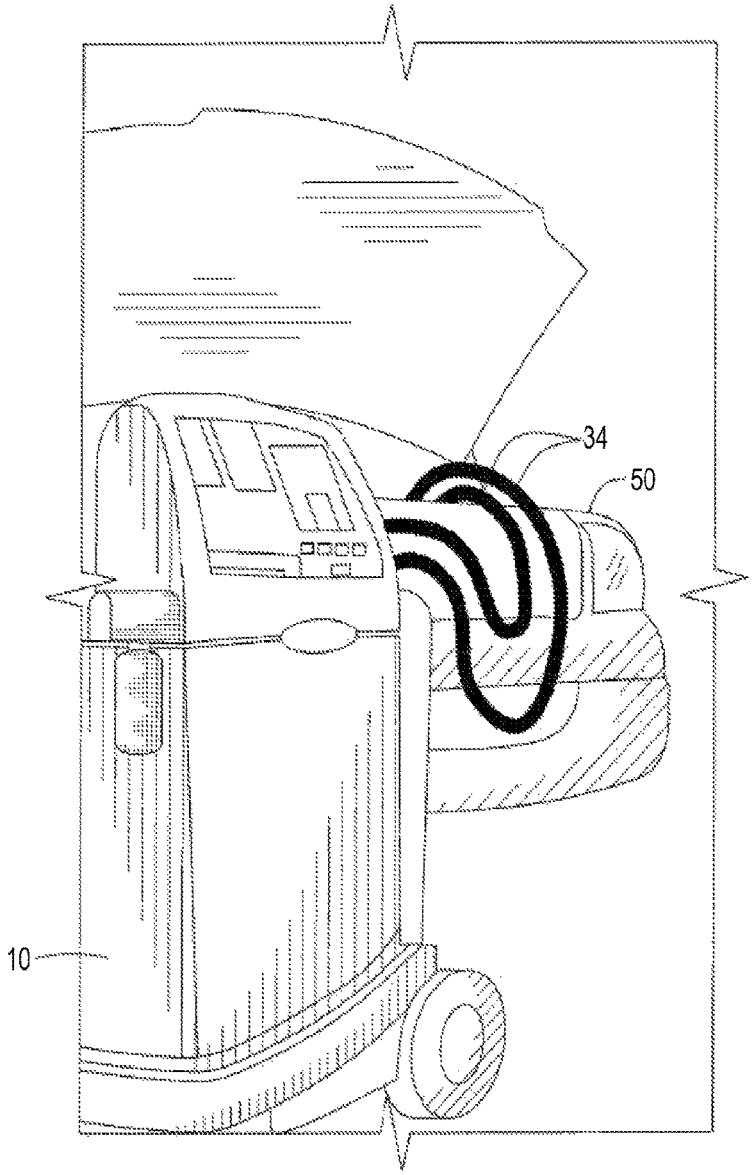
FIG. 2 PRIOR ART
FIG. 2 is side perspective view of the refrigerant service system of FIG. 1 connected to a vehicle.

FIG. 2 is an illustration of a portion of the ACS system 10 illustrated in FIG. 1 connected to a vehicle 50. Service hoses 34, 36 include coupling connectors 38, 40 (FIG. 3) configured to connect an inlet and/or outlet port of the air conditioning circuit of the vehicle 50 to the hose connections 30 (shown in FIGS. 1 and 3) of the ACS unit 10.

Figure 3:
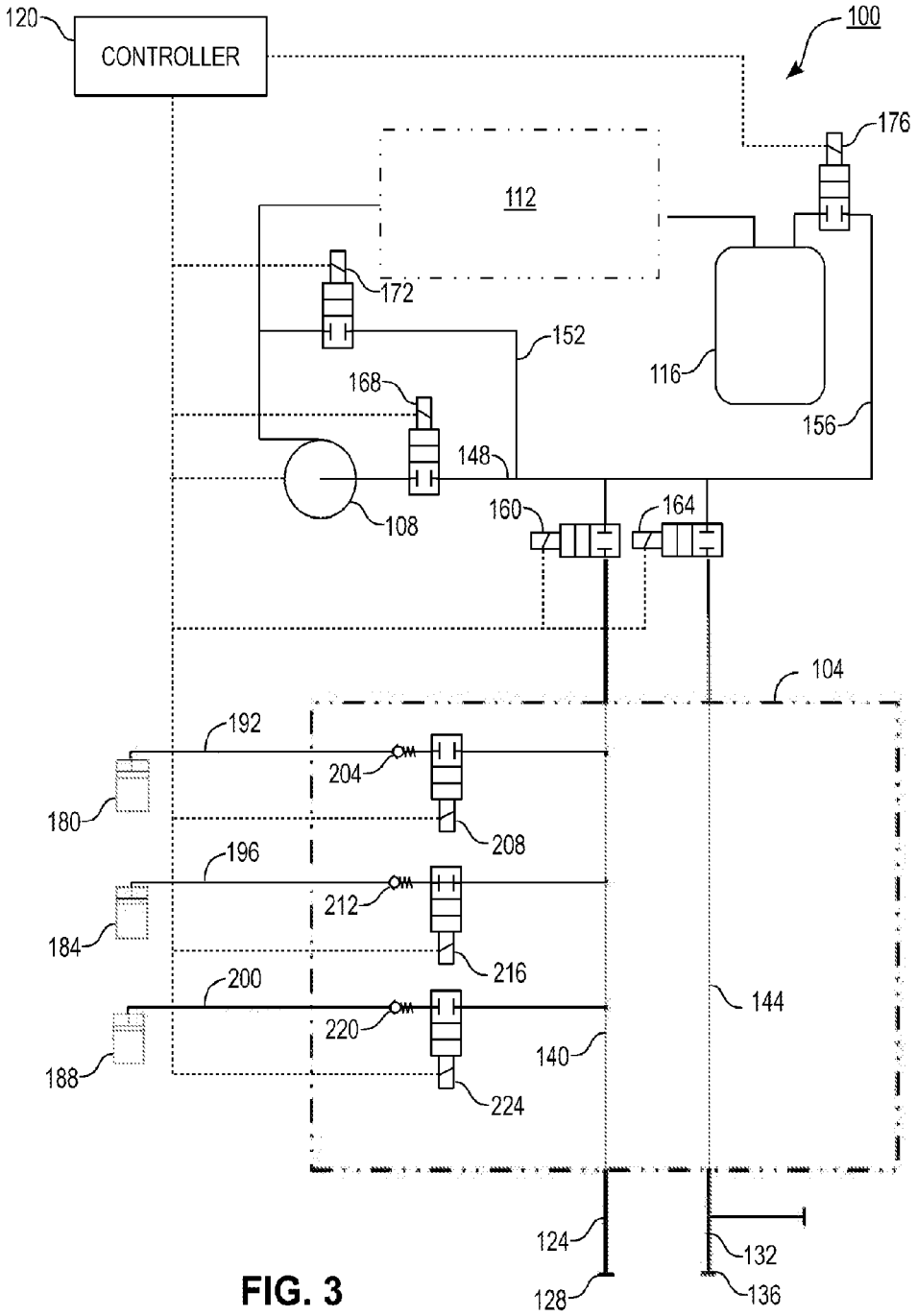
FIG. 3 is a schematic view of the refrigerant service system of FIG. 1.

FIG. 3 illustrates a schematic diagram of the ACS system 10. The ACS system 10 includes a bulkhead manifold 104, a vacuum pump 108, a recovery manifold 112, the ISV 14, and a controller 120. In some embodiments, one or both of the bulkhead manifold 104 and the recovery manifold 112 are at least partially integrated within the manifold block 16, while in other embodiments the bulkhead manifold 104 and the recovery manifold are separate from the manifold block 16.

The high-side service hose 34 and the low-side service hose 36 connect to the coupling ports 30, 32 of the bulkhead manifold 104 at one end, and the hose couplers 38, 40 at the other end of the service hoses 34, 36 are configured to attach to the high-side and low-side, respectively, of the air conditioning circuit of the vehicle 50. The bulkhead manifold 104 includes a high-side line 140 and a low-side line 144 fluidly connecting the coupling ports 30, 32, respectively, to a vacuum line 148, a recovery line 152, and an ISV charge line 156 through a high-side solenoid valve 160 and a low-side solenoid valve 164, respectively.

The vacuum pump 108 and a vacuum solenoid valve 168 are disposed in the vacuum line 148. A recovery solenoid valve 172 is located in the recovery line 152, which fluidly connects the recovery manifold 112 to the high-side and low-side lines 140, 144. The recovery manifold 112 includes components, for example a compressor, oil separators, a heat exchanger, and filters and dryer units, configured to remove oil entrained in refrigerant and purify the refrigerant when the refrigerant is recovered from an air conditioning circuit. The purified refrigerant is then stored in the ISV 14. The ISV charge line 156 connects the ISV 14 to the high-side and low-side lines 140, 144 through a charge solenoid valve 176 to enable recharging refrigerant from the ISV 14 to the air conditioning circuit.

A first oil receptacle 180, a second oil receptacle 184, and a dye receptacle 188 are fluidly connected to a first oil supply line 192, a second oil supply line 196, and a dye supply line 200, respectively. A first oil injection check valve 204 and a first oil injection solenoid valve 208 are fluidly connected to the first oil supply line 192, a second oil injection check valve 212 and a second oil injection solenoid valve 216 are fluidly connected to the second oil supply line 196, and a dye injection check valve 220 and a dye injection solenoid valve 224 are fluidly connected to the dye supply line 200. The solenoid valves 208, 216, 224 are fluidly connected to the high-side line 140 via a first oil injection line 226, a second oil injection line 228, and a dye injection line 230, respectively. In some embodiments, the solenoid valves 208, 216, 224 are directly connected to the high-side line 140 such that the high-side line 140 is the oil injection line.

Each of the first and second oil receptacles 180, 184 is configured to store a type of oil. In some embodiments, the oil stored in the first oil receptacle 180 has a different viscosity and different thermal properties than the oil stored in the second oil receptacle 184 to enable use of the ACS system 10 with a wider variety of air conditioning circuits. The dye receptacle 188 stores dye, which can be injected into the air conditioning circuit to aid a user in diagnostic operations, for example locating a leak in the air conditioning circuit. In some embodiments, one or both of the oil receptacles 180, 184 are connected to the recovery manifold 112 by a system oil return line (not shown) to transfer oil separated from recovered refrigerant back into the oil receptacle 180, 184 for subsequent reuse.

The injection check valves 204, 212, 220 and solenoid valves 208, 216, 224 are all disposed in the bulkhead manifold 104 in the embodiment of FIG. 3, though in other embodiments the valves 204, 208, 212, 216, 220, 224 may be in another manifold or installed individually within the ACS machine 10. In the embodiment of FIG. 3, the ACS machine 10 includes two oil receptacles 180, 184 and one dye bottle 188. In some embodiments, the ACS machine includes only one oil receptacle or more than two oil receptacles. In other embodiments, the ACS machine does not include a dye receptacle or the associated valves and lines, or the ACS machine may include more than one dye bottle to store different types of dye.

Figure 4:
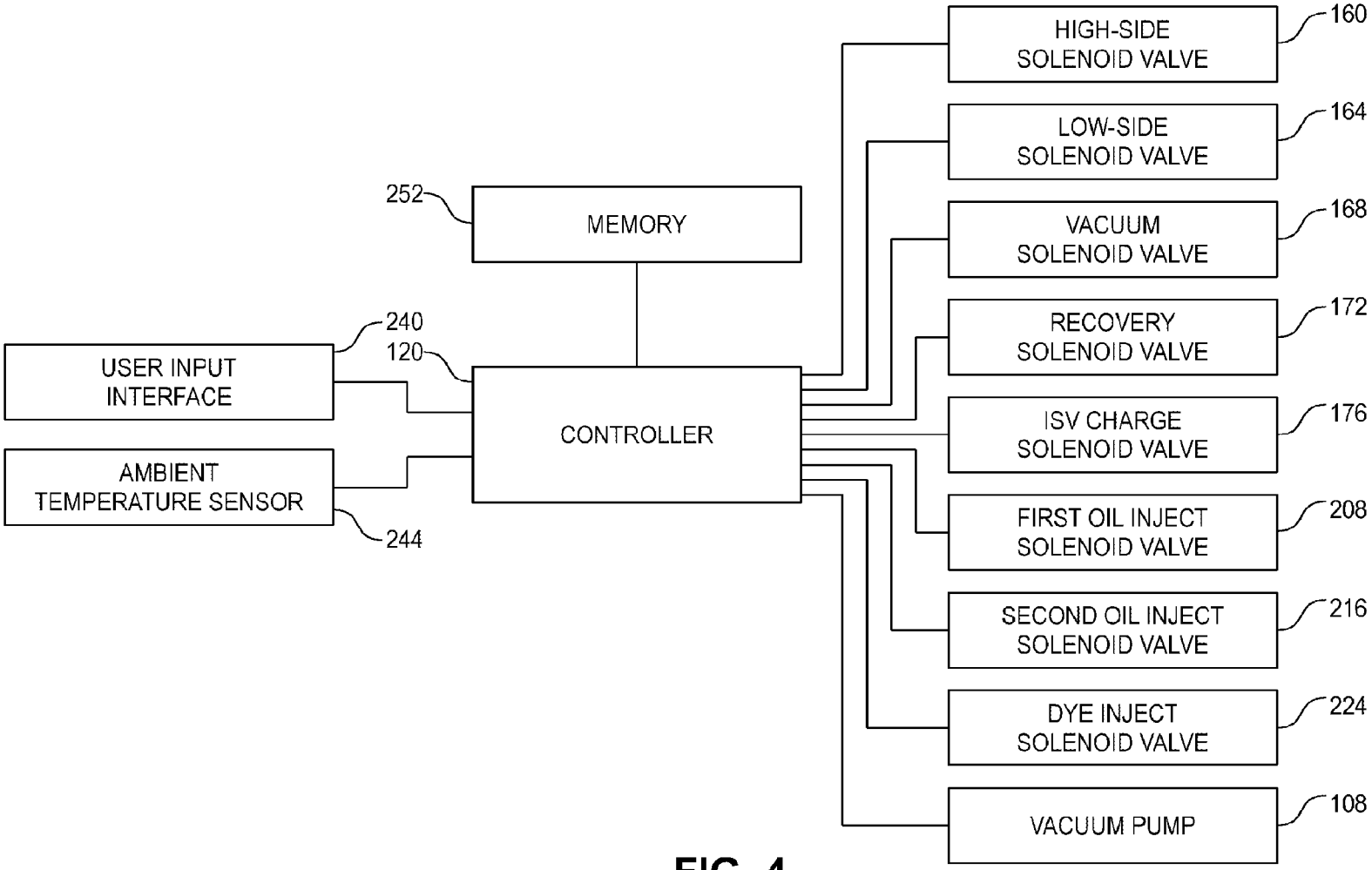
FIG. 4 is a schematic view of the control components of the refrigerant service system of FIG. 1.

FIG. 4 illustrates a schematic diagram of a control system 236 for the ACS machine 10. The control system 236 includes the controller 120, which is operably connected to a user input interface 26. The controller 120 is configured to receive inputs from the user input interface 26, and, in some embodiments, display information for a user on the user input interface 26. The controller 120 is also operably connected to an ambient temperature sensor 244, which is configured to sense the ambient temperature of the ACS unit 10 and generate electronic signals corresponding to the ambient temperature. In some embodiments, an oil receptacle temperature sensor, which senses the temperature of the oil in the oil receptacle, is used in place of the ambient temperature 244.

The controller 120 is operably connected to a memory 252 to store data received from the user input interface 26 and the temperature sensor 244. The controller 120 and the memory 252 may be integrated in the control module 20 of the ACS system 10. In some embodiments, in addition to or as an alternative to storing the data in the memory 252, the data is stored outside the ACS machine 10. In one embodiment, the data is transmitted via a wired or wireless internet connection to a "cloud" storage location. In another embodiment, the data is transmitted to a memory device such as a hard disk drive, a USB drive, a solid state drive, a network attached storage (NAS) device, or the like. The controller 120 is also operably connected to the solenoid valves 160, 164, 168, 172, 176, 208, 216, 224 and to the vacuum pump 108. The controller 120 is configured to transmit electronic signals to operate the solenoid valves 160, 164, 168, 172, 176, 208, 216, 224 to an open or closed condition and to operate the vacuum pump 108 to activate and deactivate.

Operation and control of the various components and functions of the ACS machine 10 are performed with the aid of the controller 120. The controller 120 is implemented with general or specialized programmable processors that execute programmed instructions. The instructions and data required to perform the programmed functions are stored in the memory unit 252 associated with the controller 120, or in a memory unit (not shown) integrated in the controller 120. The processors, memory, and interface circuitry configure the controller 120 to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, the high-side and low-side hose couplers 38, 40 are connected to the high-side and low-side connection ports of an air conditioning circuit, for example an air conditioning system of vehicle 50 of FIG. 2. To perform a recovery operation, the recovery solenoid 172 and one or both of the high-side and low-side solenoids 160, 164 are opened. Compressed refrigerant within the air conditioning system flows to the recovery manifold 112, where system oil entrained in the refrigerant is separated from the refrigerant and the refrigerant is purified for storage in the ISV 14.

It is often necessary during normal maintenance of an air conditioning circuit to replace the system oil entrained in the refrigerant removed from the air conditioning system so that the air conditioning system continues to perform optimally. As such, an oil injection operation is performed after the refrigerant recovery operation, during which the refrigerant is recovered from the air conditioning circuit, and prior to a refrigerant recharge operation, during which refrigerant is recharged into the air conditioning circuit. Once the recovery operation is complete, the recovery solenoid 172 is closed, the vacuum solenoid 168 is opened, and the vacuum pump 108 is activated. The vacuum pump 108 produces a negative pressure in the high-side and low-side lines 140, 144, pulling any remaining refrigerant from the air conditioning circuit and reducing the pressure in the air conditioning circuit below atmospheric pressure. The high-side and low-side solenoid valves 160, 164 are then closed and the vacuum pump 108 is deactivated to close off the air conditioning system and retain the air conditioning system at the vacuum pressure.

The controller 120 then controls one of the oil injection solenoids 208, 216 to open. In some embodiments, the controller 120 is programmed to automatically select the appropriate solenoid valve 208, 216 to open, while in other embodiments a user instructs the controller 120 which oil injection solenoid valve 208, 216 to open via the user input interface 26, an external electronic device operably connected to the controller 120, or a combination thereof. Opening one of the oil injection solenoids 208, 216 fluidly connects the associated oil receptacle 180, 184 to the respective check valve 204, 212, which opens due to the negative pressure in the air conditioning system and the high-side line 140. As such, the respective oil receptacle 180, 184 is fluidly connected to the air conditioning circuit via the high-side line 140.

The flow rate of the oil through the solenoid valve 208, 216 into the air conditioning circuit is dependent on the absolute viscosity of the oil, which is a function of the temperature and viscosity rating, or oil type, of the oil. As discussed in further detail below, the controller 120 is therefore configured to determine the absolute viscosity of the oil based on the current ambient temperature and the viscosity rating or oil type of the oil, and to calculate the flow rate based upon the absolute viscosity of the oil. The controller 120 is further configured to calculate the length of time the respective solenoid valve 208, 216 is to be open based on the quantity of oil desired to be injected into the air conditioning system and the calculated flow rate. The controller 120 then controls the respective oil injection solenoid valve 208, 216 to open for the calculated length of time to inject the desired amount of oil into the high-side line 140 and the air conditioning system.

Once the oil has been injected, the controller 120 controls the respective oil injection solenoid valve 208, 216 to close and performs a recharge operation. During the recharge operation, the charge solenoid valve 176 and the high-side solenoid valve 160 are opened. Refrigerant in the ISV 14 flows from the ISV 14 through the high-side line 140 into the air conditioning circuit. Any residual oil remaining in the high-side line 140 from the oil injection operation is entrained in the refrigerant and transferred to the air conditioning circuit. In some embodiments, the low-side solenoid valve 164 is also opened during the recharge operation such that refrigerant flows from the ISV 14 through both the high and low side lines 140, 144 into the air conditioning circuit.

Figure 5:
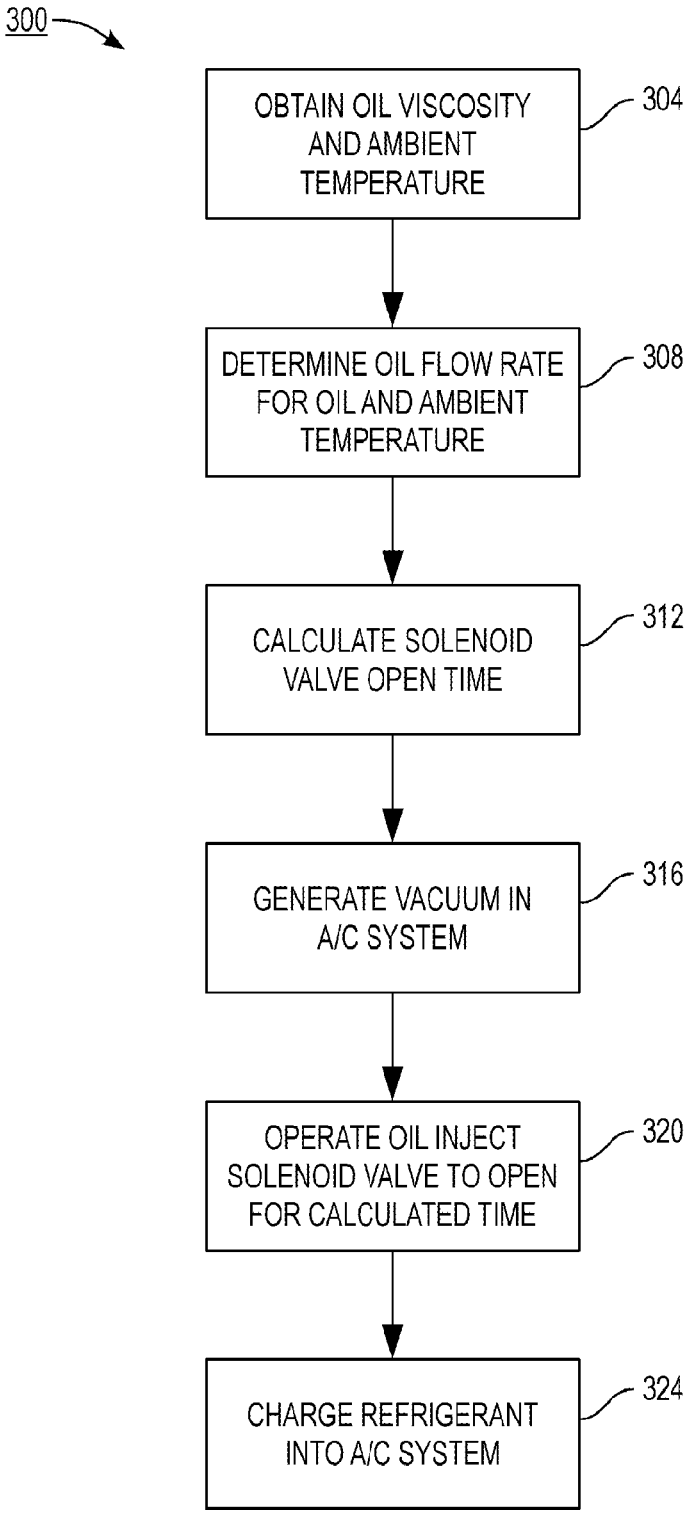
FIG. 5 is a process diagram of a method of operating a refrigerant service system to inject oil into an air conditioning system.

FIG. 5 is a process diagram of a method 300 of injecting oil into an air conditioning circuit. The controller 120 of the refrigerant service system 10 includes a processor configured to execute programmed instructions stored in a memory associated with the controller to implement the method 300.

The method 300 begins with the controller 120 obtaining the rated viscosity of the oil and the ambient temperature (block 304). In one embodiment, the rated viscosity of the oil, or the type of oil, and the ambient temperature are input by the user via a user input interface, such as the user input interface 26 of the embodiment of FIGS. 3 and 4. In another embodiment, the user inputs the rated viscosity of the oil or the oil type, and the controller obtains the ambient temperature from the temperature sensor 244. In a further embodiment, the rated viscosity or the oil types of the oils stored in the oil receptacles are stored in the memory 252 when one of the oil receptacles is filled or changed or the rated viscosity is programmed into the memory 252 during manufacture of the ACS machine 10, and the rated viscosity is obtained by the controller 120 from the memory.

Figure 9:
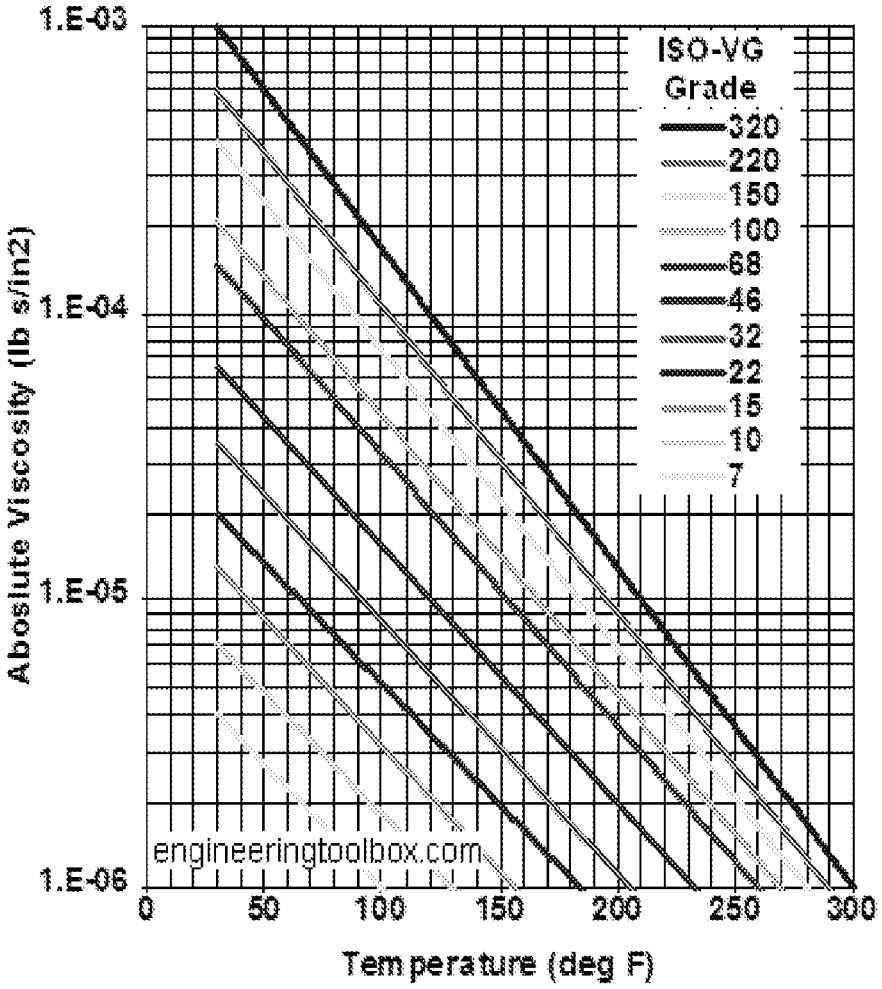
FIG. 9 is a graph of oil absolute viscosity as a function of temperature for a variety of different oils.

The controller 120 then determines the absolute viscosity of the oil and the corresponding flow rate of the oil at the ambient temperature (block 308). In one embodiment, tables or charts of oil absolute viscosity for various different oil types or rated viscosities at various temperatures are stored in the memory 252. One example of a chart of oil absolute viscosity as a function of temperature for a variety of oil grades is shown in FIG. 9. The controller 120 recalls the absolute viscosity of the oil from the table or chart based on the ambient temperature and the rated viscosity of the oil.

The flow rate of the oil is dependent primarily on the size of the tubes and openings connecting the oil receptacle and the air conditioning system (for example oil supply and injection lines 192, 196, 226, 228 check valves 204, 212, and solenoid valves 208, 216), the length of the lines, the pressure difference between the oil receptacle and the air conditioning circuit, and the absolute viscosity of the oil. The size and length of the oil path are constants, and may be programmed into the memory 252 of the ACS system 10. In some embodiments, the pressure difference is calculated based on a pressure signal received from a pressure transducer configured to determine the pressure in the air conditioning circuit. In other embodiments the pressure is assumed based upon a known vacuum condition in the air conditioning circuit and the ambient pressure, which is either measured or assumed. The controller is then configured to determine the flow rate of the oil at the determined absolute viscosity. In another embodiment, the system includes a viscosity sensor configured to sense the viscosity of the oil, which the controller uses to calculate the flow rate of the oil.

Next, the controller 120 calculates the length of time to open the oil injection solenoid valve (block 312). For simplicity of description, the remainder of the method 300 will be described with reference to oil being transferred from the oil receptacle 180 through solenoid valve 208 and oil injection line 226, through the reader should appreciate that the oil may be transferred from the second oil receptacle 184 in a similar manner. In one embodiment, the user inputs an amount of oil to inject into the air conditioning system into the user input interface 24, which transmits a volume signal to the controller 120. In another embodiment, the user inputs a vehicle type, air conditioning circuit model, or air conditioning circuit refrigerant capacity to the user input 24 of the ACS machine 10 and the controller 120 recalls a volume signal representing the amount of oil to inject from the memory 252 based upon the value input by the user. In a further embodiment, the ACS machine 10 determines the quantity of oil removed from the air conditioning circuit during the recovery operation and stores the quantity of oil removed in the memory 252, and the controller 120 recalls a volume signal corresponding to the removed quantity to determine the amount of oil to inject into the air conditioning circuit. The controller 120 then determines the length of time the oil injection solenoid valve 208 is open based on the amount of oil to inject and the oil flow rate.

The controller 120 controls the vacuum pump 108 to generate a vacuum pressure in the air conditioning circuit, the high-side line 140, and the oil injection line 226 (block 316). The reader should appreciate that the generation of the vacuum pressure may be performed before, during, or after the determination of the oil viscosity and the valve open time. In one embodiment, the controller controls the high-side solenoid valve 160, the vacuum solenoid valve 168, and the vacuum pump 108 to generate the vacuum, closing the valves 160, 168 to retain the air conditioning circuit, the high-side line 140, and the oil injection line 226 at the vacuum pressure.

Once the air conditioning circuit is at vacuum pressure and the opening time for the oil injection solenoid valve 208 has been calculated, the controller controls the oil injection solenoid valves 208 to open for the calculated time (block 320), such that the amount of oil flows through the solenoid valve 208 into the oil injection line 226, the high-side line 140, and the air conditioning circuit. After the valve 208 is open for the calculated length of time, the controller 120 controls the valve 208 to close. Refrigerant is then charged into the air conditioning circuit by, for example, opening the charge solenoid valve 176 and the high-side solenoid valve 160 to open a path from the ISV 14 to the air conditioning circuit (block 324). Refrigerant flows from the ISV 14 into the air conditioning circuit, capturing any oil remaining in the oil injection line 226 and the high-side line 140 and transferring the oil into the air conditioning circuit.

Figure 6:
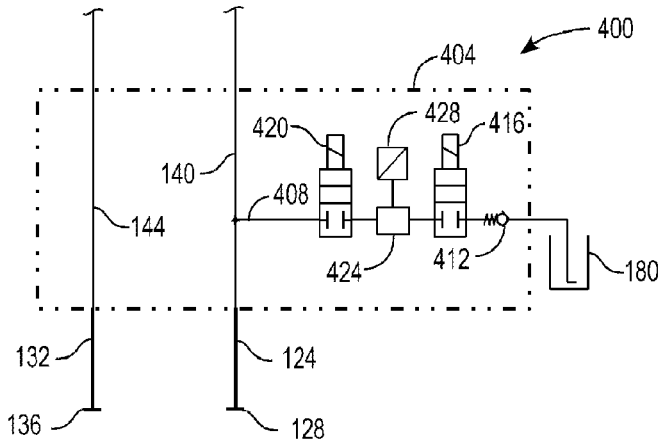
FIG. 6 is a schematic view of an oil injection system for a refrigerant service system according to the disclosure.

FIG. 6 illustrates another oil injection system 400 for a refrigerant service system, which can be used in place of the oil injection system of the refrigerant service system 10 depicted in FIG. 3. The oil injection system 400 is disposed in a bulkhead manifold 404, and includes an oil supply line 408, a check valve 412, a first solenoid valve 416, a chamber 420, a second solenoid valve 424, an oil supply line 428, and a pressure transducer 432.

The oil injection line 408 fluidly connects the oil receptacle 180 to the check valve 412, which is fluidly connected to the first solenoid valve 416. The chamber 420 includes an inlet 434, which is fluidly connected to the first solenoid valve 416, and an outlet 436, which is fluidly connected to the second solenoid valve 424. In some embodiments, the inlet 434 and the outlet 436 are combined into a single combination inlet/outlet line or port used to both receive and discharge oil. In some embodiments, the chamber 424 is connected to a separate line that is connected to the line between the first and second solenoid valves 416, 424, instead of being directly positioned between the first and second valves 416, 424.

The second solenoid valve 424 is fluidly connected to the oil injection line 428, which discharges oil into the high-side line 140. As described above with regard to FIG. 1, the high-side line 140 is fluidly connected to a high-side hose 34 and high-side hose coupler 38 via the coupling port 30.

The chamber 420 is configured to hold a predetermined volume of oil, which, in one embodiment, is approximately 5 mL. The pressure transducer 432 is configured to sense the pressure within the predefined volume of the chamber 420 and generate an electronic signal corresponding to the pressure within the chamber 420.

Figure 7:
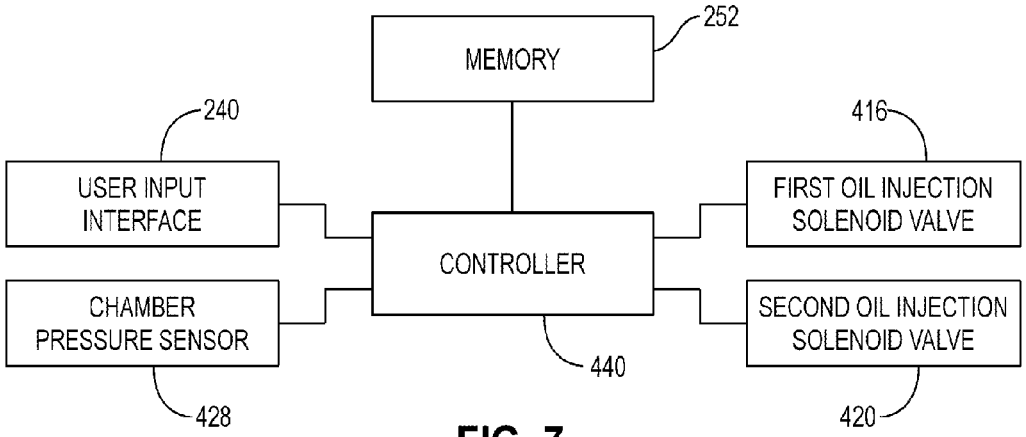
FIG. 7 is a schematic view of the control components of the oil injection system of FIG. 6.

FIG. 7 illustrates the control system 438 of the oil injection system 400 of FIG. 6. A controller 440 is operably connected to the user input interface 26 and a memory 252, both of which are configured substantially the same as described above with regard to the embodiment of FIGS. 3 and 4 and may be integrated within the control module 20 of the ACS system 10. The controller 440 is also operably connected to the chamber pressure transducer 432 to receive the signal corresponding to the pressure in the chamber 420. The controller 120 is operably connected to the first and second oil injection valves 416, 424 and configured to transmit electronic signals to control the solenoid valves 416, 424 to open and close.

Operation and control of the various components and functions of the oil injection system 400 are performed with the aid of the controller 440. The controller 440 is implemented with general or specialized programmable processors that execute programmed instructions. The instructions and data required to perform the programmed functions are stored in the memory unit 252 associated with the controller 440. The processors, memory, and interface circuitry configure the controller 440 to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, the controller 440 is configured to initiate an oil injection operation after a refrigerant recovery operation and before a refrigerant recharge operation. The oil injection operation begins with execution of a viscosity determining procedure. The viscosity determining procedure beings with the controller activating a vacuum pump (not shown in FIG. 6 or 7) to produce a vacuum in the high-side line 140, the high-side hose 34, the oil injection line 428, and the air conditioning circuit. The controller 440 then controls the second oil injection solenoid 424 to open, such that the vacuum pressure is transferred to the chamber 420. The controller 440 controls the second oil injection solenoid 424 to close, deactivates the vacuum pump, and opens the first oil injection solenoid 416. The negative pressure in the chamber 420 opens the check valve 412, drawing oil from the oil receptacle 180 through the oil supply line 408 and into the chamber 420.

The controller 440 monitors the signal produced by the pressure transducer 432 as the oil travels into the chamber 420. Once the controller 440 identifies that the pressure in the chamber 420 is equal to or greater than a predetermined threshold, which, in one embodiment, is atmospheric pressure, the controller 440 calculates the flow rate of the oil from the oil receptacle 180. The amount of time required for the chamber 420 and the known volume of the chamber 420 is representative of the viscosity of the oil. The controller 120 then generates a viscosity signal that enables the controller 440 to calculate the flow rate of the oil being transferred from the oil receptacle 180, and the viscosity determining procedure is completed.

Once the oil injection flow rate is calculated, the controller calculates the amount of time the valves 416, 420 are opened such that the desired quantity of oil is injected into the air conditioning circuit. The controller 440 then controls the second solenoid valve 424 to open, so that both valves 416, 424 are open. Oil travels from the oil receptacle 180 through the oil supply line 408 and the chamber 420, through the oil injection line 428, the high-side line 140, the high-side hose 34, and into the air conditioning circuit of the vehicle. After the calculated amount time has elapsed, the solenoid valves 416, 424 are closed and the air conditioning circuit is charged with refrigerant, capturing any remaining oil in the lines 428, 140, and the hose 34 and transporting the oil into the air conditioning circuit of the vehicle.

Figure 8:
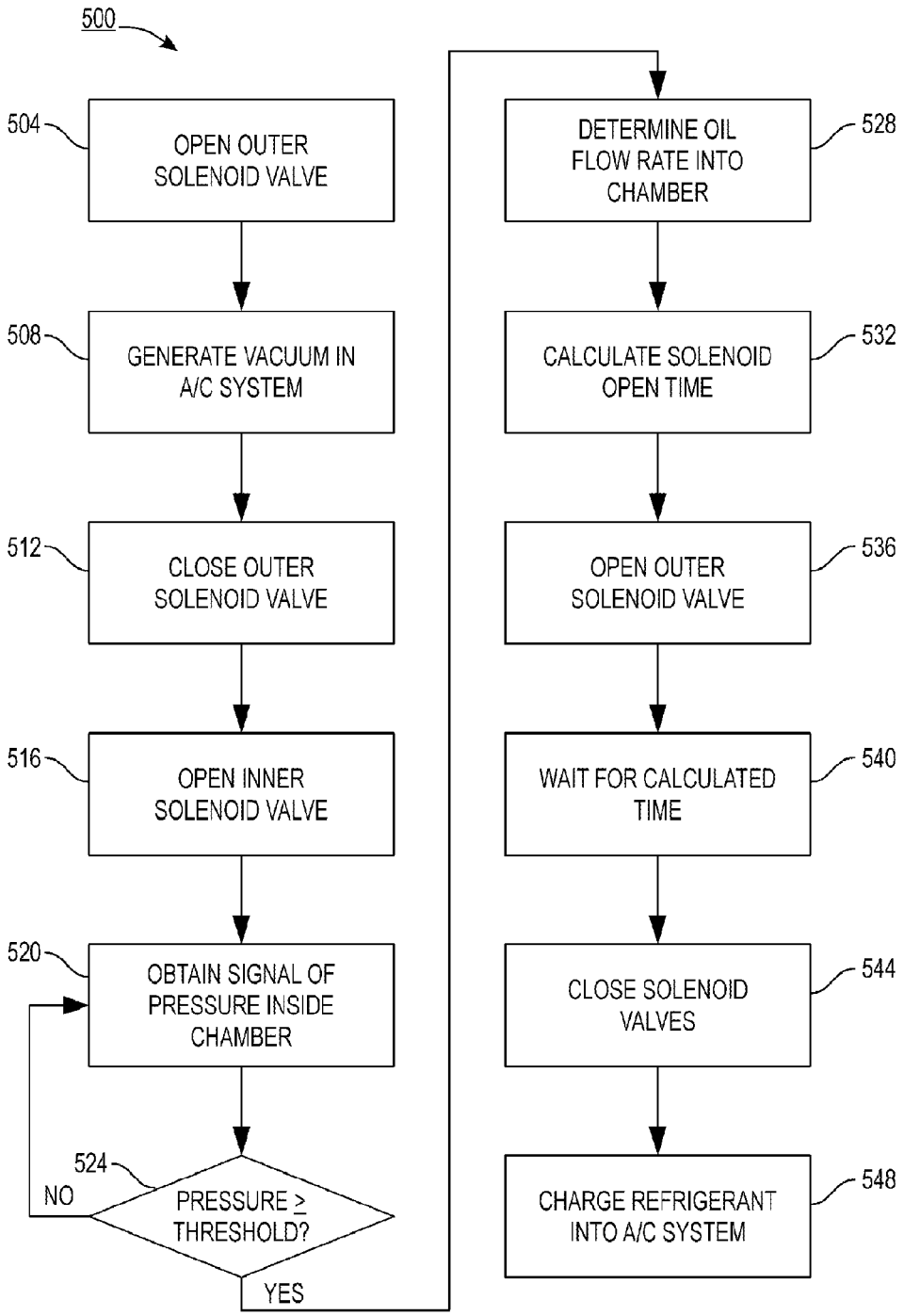
FIG. 8 is a process diagram of another method of operating a refrigerant service system to inject oil into an air conditioning system.

FIG. 8 illustrates a process diagram of a method 500 of injecting oil into an air conditioning circuit. The controller 440 of the refrigerant service system 10 includes a processor configured to execute programmed instructions stored in a memory associated with the controller to implement the method 500.

The method 500 begins with the controller 440 opening the outer solenoid valve 424 (block 504) to fluidly connect the chamber 420 to the oil injection line 428, the high-side line 140, and the air conditioning circuit. The controller 440 then controls the vacuum pump to generate a vacuum in the air conditioning circuit, the high-side line 140, the oil injection line 428, and the chamber 420 (block 508). The outer valve 424 is closed (block 512), isolating the chamber 420 from the air conditioning circuit, and an inner solenoid valve 416 is opened (block 516), connecting the oil receptacle 180 to the chamber 420. The controller 440 obtains the pressure signal produced by the pressure transducer 432 (block 520) and compares the pressure in the chamber 420 with a predetermined pressure threshold (block 524).

If the pressure is less than the threshold, the process continues at block 520 by obtaining the signal corresponding to the pressure inside the chamber 420 again. If the pressure is equal to or greater than the threshold, the controller 440 determines the average oil flow rate into the chamber 420, which is equal to the chamber volume divided by the amount of time required after opening the inner solenoid valve 416 for the pressure to reach the threshold, indicating that the chamber 420 is full (block 528). In some embodiments, the controller 440 corrects the determined average flow rate by a correction factor based upon temperature, ACS machine specifications, or other environmental or system variables. The execution of blocks 504 through 528 are referred to collectively as the viscosity determining procedure.

Based on the determined average flow rate, the controller calculates the solenoid open time (block 532), which is equal to the amount of oil desired to be injected into the air conditioning circuit divided by the determined average oil flow rate. The outer solenoid valve 424 is then opened (block 536), fluidly connecting the oil receptacle 180 to the air conditioning circuit of the vehicle. The controller 440 waits for the calculated period of time to elapse (block 540), and then controls both the inner and outer solenoid valves 416, 424 to close (block 544). The controller 440 then controls the components in the ACS system 10 to charge the air conditioning circuit with refrigerant (block 548).

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. An air conditioning service system comprising:

an oil receptacle configured to store oil;

a coupling port in fluid communication with the oil receptacle through an oil injection line;

a first solenoid valve configured to selectively allow the oil to flow from the oil receptacle into the oil injection line;

a second solenoid valve configured to selectively isolate the oil receptacle from the oil injection line;

a chamber having an inlet in fluid communication with the first solenoid valve and an outlet in fluid communication with the second solenoid valve; and a pressure sensor configured to generate pressure signals associated with pressures of the chamber;

a memory including program instructions stored therein; and a controller operably connected to the first solenoid valve, the second solenoid valve, the pressure sensor, and the memory and configured to execute the program instructions to:

obtain at least one viscosity signal associated with a viscosity of the oil, the obtaining of the at least one viscosity signal including generating the at least one viscosity signal during a viscosity determining procedure using the generated pressure signals, obtain a volume signal indicative of an amount of oil to be charged, determine a first time period based upon the obtained at least one viscosity signal and the obtained volume signal, control the first solenoid valve to an open condition, and control the first solenoid valve to a closed condition after the determined first time period has passed since opening of the first solenoid valve.

2. The air conditioning service system of claim 1, wherein the at least one viscosity signal comprises:

a first temperature signal indicative of a temperature of one of the oil receptacle and ambient surroundings of the air conditioning service system.

3. The air conditioning service system of claim 2, further comprising:

a temperature sensor configured to generate the first temperature signal.

4. The air conditioning service system of claim 1, wherein the at least one viscosity signal comprises:

a first oil type signal associated with a type of the oil.

5. The air conditioning system of claim 4, further comprising:

a vacuum pump configured to generate a vacuum in the oil injection line, wherein the controller is operably connected to the vacuum pump and further configured to execute the program instructions to operate the vacuum pump to generate a vacuum in the oil injection line prior to controlling the first solenoid valve to the open condition.

6. The air conditioning service system of claim 1, wherein the controller is configured to execute the program instructions to perform the viscosity determining procedure, the viscosity determining procedure comprising:

controlling the first solenoid valve to a closed position;

generating a vacuum in the chamber;

controlling the first solenoid valve to an open position thereby placing the chamber in fluid communication with the oil receptacle;

obtaining a first of the generated pressure signals after controlling the first solenoid valve to the open position; and generating the at least one viscosity signal based upon the obtained first of the generated pressure signals and a second time period between controlling the first solenoid valve to the open position and obtaining the first of the generated pressure signals.

7. The air conditioning service system of claim 6, wherein the viscosity determining procedure further comprises:

controlling the second solenoid valve to an open position before generating the vacuum in the chamber;

generating the vacuum in the chamber through the second solenoid valve; and controlling the second solenoid valve to a closed position after the vacuum has been generated.

8. The air conditioning service system of claim 7, wherein the viscosity determining procedure further comprises:

obtaining a second of the generated pressure signals after controlling the second solenoid valve to a closed position and prior to controlling the first solenoid valve to the open position; and generating the at least one viscosity signal based upon the obtained second of the generated pressure signals.

9. The air conditioning service system of claim 6, further comprising:

a vacuum pump configured to generate the vacuum in the chamber, wherein the controller is operably connected to the vacuum pump and further configured to execute the program instructions to operate the vacuum pump to generate the vacuum in the chamber.

10. A method of injecting oil into an oil injection line of an air conditioning service system, comprising:

obtaining with a pressure sensor pressure signals associated with pressures of a chamber having an inlet in fluid communication with a first solenoid valve and an outlet in fluid communication with a second solenoid valve that is configured to selectively isolate an oil receptacle from the oil injection line;

obtaining with a controller at least one viscosity signal associated with a viscosity of the oil, the obtaining of the at least one viscosity signal including generating the at least one viscosity signal during a viscosity determining procedure using the generated pressure signals;

obtaining with the controller a volume signal indicative of an amount of oil to be charged;

determining a first time period based upon the obtained at least one viscosity signal and the obtained volume signal by executing with the controller program instructions stored in a memory;

placing the oil injection line in fluid communication with the oil receptacle by controlling the first solenoid valve to an open condition with the controller;

flowing oil from the oil receptacle into the oil injection line through the open first solenoid valve; and controlling the first solenoid valve to a closed condition with the controller after the determined first time period has passed since opening of the first solenoid valve.

11. The method of claim 10, the obtaining of the at least one viscosity signal comprising:

obtaining a first temperature signal indicative of a temperature of one of the oil receptacle and ambient surroundings of the air conditioning service system.

12. The method of claim 11, the obtaining of the first temperature signal comprising:

obtaining the temperature signal with a temperature sensor.

13. The method of claim 10, the obtaining of the at least one viscosity signal comprising:

obtaining a first oil type signal associated with a type of the oil.

14. The method of claim 13, further comprising:

generating, with a vacuum pump operably connected to the controller, a vacuum in the oil injection line prior to controlling the first solenoid valve to the open condition.

15. The method of claim 10, the viscosity determining procedure comprising:

controlling the first solenoid valve to a closed position;

generating a vacuum in the chamber;

controlling the first solenoid valve to an open position thereby placing the chamber in fluid communication with the oil receptacle;

obtaining a first of the obtained pressure signals after controlling the first solenoid valve to the open position; and generating the at least one viscosity signal based upon the obtained first of the generated pressure signals and a second time period between controlling the first solenoid valve to the open position and obtaining the first of the generated pressure signals.

16. The method of claim 15, the viscosity determining procedure further comprising:

controlling the second solenoid valve to an open position before generating the vacuum in the chamber;

generating the vacuum in the chamber through the second solenoid valve; and controlling the second solenoid valve to a closed position after the vacuum has been generated.

17. The method of claim 16, the viscosity determining procedure further comprising:

obtaining a second of the generated pressure signals after controlling the second solenoid valve to a closed position and prior to controlling the first solenoid valve to the open position; and generating the at least one viscosity signal based upon the obtained second of the generated pressure signals.

18. The method of claim 15, the generating of the vacuum in the chamber comprising:

operating a vacuum pump operably connected to the controller to generate the vacuum in the chamber.

* * * * *